United States Patent [19]

Maringer

[11] Patent Number: 4,763,718

[45] Date of Patent: Aug. 16, 1988

[54] METHOD OF AND APPARATUS FOR CASTING AN ELONGATED METAL PRODUCT

[75] Inventor: Robert E. Maringer, Worthington, Ohio

[73] Assignee: Battelle Development Corporation, Columbus, Ohio

[21] Appl. No.: 841,973

[22] Filed: Mar. 20, 1986

[51] Int. Cl.[4] ..... B22D 11/06; B22D 11/10

[52] U.S. Cl. ..... 164/463; 164/423; 164/429; 164/430; 164/437; 164/440; 164/479; 164/488; 164/490

[58] Field of Search ..... 164/463, 479, 488, 423, 164/427, 429, 430, 437, 439, 490, 440

[56] References Cited

U.S. PATENT DOCUMENTS 359,349 3/1887 Daniels ..... 164/429 X
2,166,006 7/1939 Harbord et al. ..... 164/430

FOREIGN PATENT DOCUMENTS 43349 1/1908 Switzerland ..... 164/437

*Primary Examiner*—Nicholas P. Godici
*Assistant Examiner*—J. Reed Batten, Jr.
*Attorney, Agent, or Firm*—Barry S. Bissell

[57] ABSTRACT

Net shape or near net shape metal rod or wire 3 is rapidly solidified. Molten metal 7 is delivered to a semi-cylindrical casting channel 2 in a chill block 1 from a tundish 4 through a critically-designed metering system comprising a drain 6, an orifice formed of the casting channel 2 and a complementary volume control channel 5, and a barrier 8 which directs molten metal to the volume-control orifice.

27 Claims, 1 Drawing Sheet

METHOD OF AND APPARATUS FOR CASTING AN ELONGATED METAL PRODUCT

TECHNICAL FIELD

The inventive method relates to the art of metal wire forming. Typically, wire is made by casting or extrusion of large diameter rod, followed by many successive drawings operations to reduce the diameter and to shape and work harden the wire.

To reduce the number of drawing steps, several processes have been proposed to produce near-net-shape or net-shape wire or rod. U.S. Pat. No. 405,914 to F. W. Schultz discloses a method for casting wire solder in grooves. However, in the Schultz system, nozzles over or inside the grooves deliver molten metal into the grooves. Experimentation with nozzles has shown that they are very difficult to control. The rate at which the metal flows out of the nozzle (the speed of movement) must be approximately equal to the speed of the groove, otherwise turbulence is created which interferes with the uniformity of the casting. Further, the amount of metal flowing through the orifice per unit time must be exactly right to fill the groove. It is relatively easy to reach these two objectives at very slow speeds, but difficult for higher speeds. Since one the the control means is the speed at which the groove moves, it would be extremely difficult to use the Schultz-type nozzle on a multiple-strand production operation.

U.S. Pat. No. 3,939,900 to Polk and Bedell discloses a process for casting metal in a V-shaped groove lined with thermal insulating material which is not wetted by the molten metal. Once again, control over the volume delivery of molten metal is a problem.

SUMMARY

Despite some work in the area, a practical method for near-net-shape casting of metal wire has not yet been proved. The present invention has, as its objective, the provision of a practical method for commercial production of such near-net-shape elongated metal products, particularly wire or rod, by rapid solidification.

The method generally comprises metering molten metal from a source thereof to an elongated, moving casting channel in a chill block. The molten metal is metered to the casting channel under positive pressure from the source through a flow-restricting orifice comprised of the casting channel and a complementary volume-control channel. The orifice is designed such that it is not substantially larger than the cross-section of the desired elongated metal product and, preferably, that it is equal to or slightly smaller in cross section.

Preferably, wire or rod is cast using a semi-cylindrical casting channel. In that case, the complementary volume-control channel is also semi-cylindrical with a diameter slightly less than the casting channel. The casting channel preferably has sharp corners at the upper surface of the chill block which, combined with surface tension, prevents the molten metal from escaping the channel and causes the unconfined molten metal to form a rounded upper surface.

DESCRIPTION OF THE INVENTION

The invention relates to an apparatus and method for forming elongated metal products, particularly near-net-shape and net-shape products, by rapid solidification. Typical continuous casting methods to produce net-shape precursors such as billets, ingots, rods, etc., typically operate at speeds on the order of 1 meter per minute. Subsequent drawing operations further slow the overall production process and add to energy costs. The present process is useful to cast near-net-shape and net-shape products at rates of at least about 1 meter per second.

Figure 1:
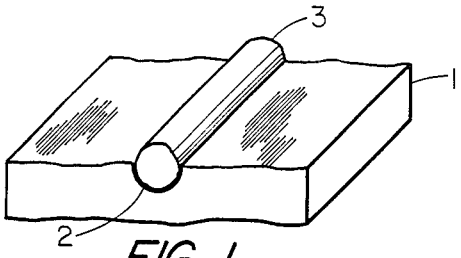
FIG. 1 is a view of a metal wire cast in a chill block.

The method and apparatus are exemplified in the Figures. FIG. 1 shows a chill block 1 having a casting channel 2 in its upper surface for forming an elongated wire 3. The disclosed casting channel has the preferred semi-circular cross-section (semi-cylindrical elongation). If the edges of the casting channel are "sharp", molten metal delivered to the channel resists pouring out of the channel. Then, if the channel is over filled with melt, surface tension and the sharp edges tend to cause the melt to stay within the channel and to form a rounded upper surface. In the smaller diameters, the cross-sectional shape of the melt may be substantially circular. Chilling the cast melt in this shape results in elongated rods or wire.

By the term "sharp" I mean that the channel wall and the upper surface of the chill block should meet at an edge with a very small radius of curvature, preferably on the order of less than a quarter of a millimeter. It is also preferred that they meet at an angle of about 90°. The "sharpness" is clearly a matter of degree and those practicing the invention can easily find the necessary conditions to meet the desired melt shape in the channel.

Longitudinal score lines resulting from machining the casting channel appear not to adversely affect casting. Transverse score lines appear to interfere with melt flow by causing turbulence. Burrs, laps or other high relief marks definitely adversely affect castings and hinder release of the solidified products.

Critical to casting net-shape products at high rates according to the invention is the apparatus and method for controlled delivery of molten metal to the casting channel. Prior methods of delivering a stream of melt through a nozzle lack the control for high rate production of uniform product.

Figure 3:
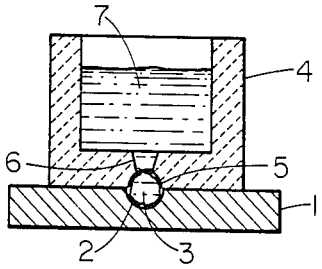
FIG. 3 is a front, sectional elevation of the apparatus of FIG. 2 taken along section line 3—3 in FIG. 2.
Figure 2:
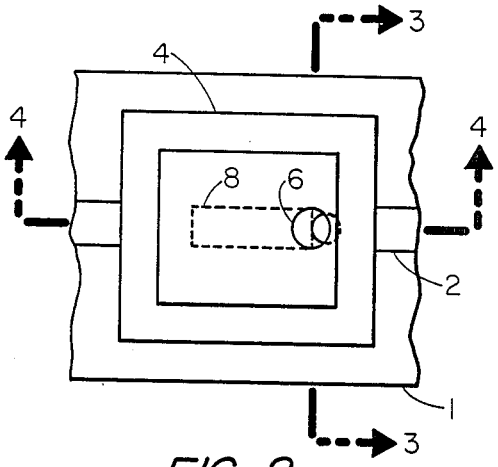
FIG. 2 is a plan view of apparatus according to the invention for casting metal wire in a casting channel.
Figure 4:
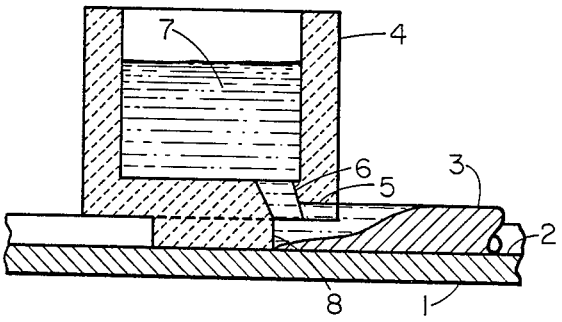
FIG. 4 is a side, sectional elevation of the apparatus of FIG. 2 taken along section line 4—4 of FIG. 2.

FIGS. 2–4 exemplify apparatus useful in metering molten metal to the casting channel to form, for example, wire or rod 3. The chill block 1 again has a semi-cylindrical casting channel 2 in the upper surface. Molten metal 7 is contained in tundish 4. Appropriate superstructure (not shown) is applied to the tundish or the casting channel (generally in a chill block) to provide relative motion therebetween. Preferably, the chill block/casting channel is a continuous caterpillar type track providing the relative movement to the fixed tundish.

The tundish 4 is made of a refractory material and has a drain 6 in the bottom leading to a flow-restricting orifice which acts to meter the volume and pressure of molten metal to the casting channel. The orifice cross section at its smallest point is preferably equal to or less than the cross section of the metal product. The larger diameter or shorter length the orifice, the larger the flow rate of melt; the smaller or longer the orifice, the smaller the flow rate. An orifice of slightly larger size than the product might temporarily be tolerated by increasing the speed of the casting channel, but the speed also causes more drag of the melt and eventually an excess of melt would upset the balance of the system making control difficult.

The flow-restricting orifice is not so much a pressure-reducer as it is a volume and velocity reducing element. Since the casting channel forms part of the orifice, the orifice adjusts (lowers) the velocity of melt flowing through the drain to the relative velocity of the casting channel, thereby reducing turbulence for a more uniform product. It also limits the volume of melt to that necessary to complete the product and may also contribute roughly to shape of the product (the surface tension ultimately determines the final shape).

In theory, the size of the drain and not the orifice could be used to control the volume of melt delivered to the casting channel. However, this approaches the problem of former nozzles, in that the drain would have to be exactly the right size. Turbulence would also still be a problem.

In the Figures, the orifice is comprised of the casting channel, itself, and a complementary volume-control channel 5 in the underside of the tundish. The volume-control channel 5 is shown in its preferred shape (semi-cylindrical) and size (slightly smaller in diameter than the casting channel). As shown best in FIG. 4, the volume-control channel extends the thickness of the front wall of the tundish 4 and communicates with the drain 6.

A barrier 8, also of semi-cylindrical shape, is preferably formed on the underside of the tundish. The barrier is desirable in the process to guide the tundish relative to the casting channel and to prevent molten metal from moving the wrong direction in the casting channel when metered from the tundish.

The drain 6 in the tundish should be large enough to avoid plugging. It preferably has a slight angle and taper toward the flow-restricting orifice to give a forward momentum to the metal flow, but this does not appear critical.

Figure 5:
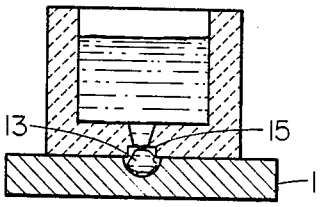
FIG. 5 is a front, sectional elevation view of apparatus according to the invention showing an alternative complementary volume-control channel.
Figure 6:
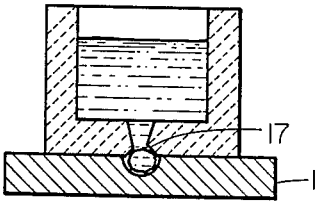
FIG. 6 is a front, sectional elevation view of apparatus having a second alternative complementary volume-control channel.
Figure 7:
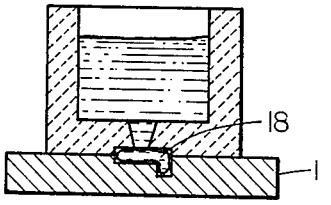
FIG. 7 is a front, sectional elevation view of apparatus according to the invention for forming angle iron.

When casting rod or wire, the volume-control channel is preferably a mirror image of the casting channel. Other shapes may also be used for the volume-control channel, such as the square or triangular channels 15 and 17, respectively, of FIGS. 5 and 6, but the cross-sectional shape of the cast rod tends to be somewhat affected such as shown by rod 13 in FIG. 5. But surface tension tends to round the melt after it leaves the orifice. Other elongated products may also be formed using the invention. FIG. 7 shows the formation of angle iron 18. A variety of tees, squares, ovals, triangles, bars or other shapes may also be formed. The rod or wire tend to be the most practical due to the rounded upper surface. The wire size depends somewhat on the density and surface tension of the particular melt. In general, wire of between about 1 and 10 mm diameter is formable. Larger sizes begin to have the noticeable effects of gravity whereas smaller sizes begin to cause problems relating to small orifice and drain delivery holes.

In the inventive process the tundish is fairly small to maintain a short residence time for the molten metal. A relatively smooth and continuous flow of molten metal is desirable. To this end, a constant head height should be maintained in the tundish. The head pressure sure forces the molten metal out the drain and into the flow-restricting orifice. The barrier prevents the molten metal from moving in an upstream direction relative to the motion of the casting channel. At higher speeds, the barrier is not as important because the casting channel tends to drag the molten metal from the orifice and drain. Flow rate is controlled by a combination of the head height, the orifice diameter and length, and the casting speed.

As molten metal is metered to the casting channel it forms a metallurgical bond therewith and a thin shell is solidified. The metering system provides sufficient additional molten metal to complete the cross-section of the product. Thereafter, the product shrinks as it cools and then releases from the channels.

The casting channel does not need to be formed in a chill block, though, for purposes of effective cooling it may be desirable. Successful castings have been made, for example, in a piece of cooled, thin-walled angle iron.

EXAMPLES

A 13 mm-thick copper plate, 76 cm in diameter was used as a chill block to cast round wire. Casting channels having semi-circular cross-sections and 3.2 mm, 4.8 mm and 6.35 mm diameters were machined around the face of the plate.

Small tundishes, such as shown in FIGS. 2–4, were made out of a fibrous refractory material (Kaowool). The drain hole was about 2 mm in diameter. Type 304 stainless steel was cast in each of the casting channels. In each case the volume-control channel and the barrier were semi-circular in cross section and slightly smaller in diameter than the corresponding casting channel.

Most of the effort concentrated on the 6.35 mm casting channel. A steady pour of molten steel into the tundish produced a steady flow to the casting channel. The chill block was rotated to produce a casting speed of between about 15 and 70 cm/sec. Wire with a substantially circular cross section was cast, however, vibration appeared to cause some irregularities. The steel wire was successfully reduced in diameter from 6.35 to 3 mm by drawing.

Other castings were made in the same fashion with Kanthal (Fe-20Cr-5Al), tin, copper and cartridge brass. All were reasonably round and could be swaged or drawn to half their original 6.35 mm diameter.

I claim:

1. A method for casting elongated, uniform metal products comprising metering molten metal from a source thereof to overfill an elongated casting channel in a chill body by delivering the molten metal under positive pressure from the source through a flow-restricting orifice comprised of the casting channel and a complementary volume-control channel and by adjusting the smallest cross-sectional area of the orifice to be not substantially larger than the cross-sectional area of a desired elongated metal product and providing for relative motion between the casting channel and the molten metal source such that the molten metal is partially solidified within, and completely solidified after leaving the flow-restricting orifice.

2. The method of claim 1 wherein the elongated casting channel is formed in a chill block.

3. The method of claim 1 wherein the elongated casting channel is formed in an upper surface of a chill block.

4. The method of claim 3 wherein the elongated casting channel is defined by a casting surface forming a sharp edge with the upper surface of the chill block.

5. The method of claim 4 wherein the casting channel is defined by the casting surface forming an angle of about 90° with the upper surface of the chill block.

6. The method of claim 1 wherein the elongated channel comprises a semi-cylindrical casting channel.

7. The method of claim 6 wherein the semi-cylindrical casting channel is formed in an upper surface of a chill block.

8. The method of claim 6 wherein the flow-restricting orifice is cylindrical and comprised of the casting channel and a semi-cylindrical, volume-control channel having a diameter not larger than the diameter of the casting channel.

9. The method of claim 1 further comprising preventing the flow of molten metal in a direction upstream of the flow-restricting orifice by means of a barrier in the casting channel upstream of the orifice and fixed to the molten metal source.

10. The method of claim 1 wherein the molten metal source comprises a tundish and the flow-restricting orifice is comprised of the elongated casting channel and the complementary volume-control channel formed in a lower surface of the tundish.

11. The method of claim 1 wherein the source of molten metal is fixed and the elongated casting channel moves in a direction substantially parallel to its direction of elongation.

12. The method of claim 11 wherein the elongated casting channel is formed in an endless belt.

13. The method of claim 12 wherein the elongated casting channel is formed in a multiplicity of chill blocks cooperating in a caterpillar-track-type endless belt.

14. The method of claim 1 wherein the molten metal is delivered under only the metallostatic head pressure.

15. The method of claim 1 wherein the molten metal is delivered under external gas pressure applied to the molten metal source.

16. A method for casting near-net-shape wire product comprising metering molten metal from a fixed tundish to overfill an elongated, semi-cylindrical casting channel in an upper surface of a chill block under positive pressure through a flow-restricting orifice and a drain communicating the tundish with the flow restricting orifice, wherein the flow-restricting orifice comprises the casting channel and a complementary semi-cylindrical volume-control channel, adjusting the size of the volume-control channel such that the minimum cross-sectional area of the flow-restricting orifice is not substantially larger than the cross-sectional area of the wire product, cooling and providing movement of the elongated casting channel substantially parallel to the direction of its elongation such that the molten metal remains partially liquid after leaving the flow-restricting orifice allowing rounding of an upper portion of the wire product due to surface tension, and solidifying the remaining portion of the molten metal to a wire product.

17. A method for casting near-net-shape elongated metal products comprising providing an elongated casting channel having a casting surface in the shape of a desired metal product, providing a tundish comprising a reservoir containing molten metal and an elongated volume-control channel on a lower surface of the tundish communicating with the reservoir, aligning the elongated casting channel and the elongated volume-control channel to form a flow-restricting orifice having a minimum cross-sectional area not substantially larger than the cross-sectional area of the metal product, providing relative motion between the elongated casting channel and the elongated volume-control channel substantially parallel to the direction of elongations filling the flow-restricting orifice with molten metal from the tundish, and cooling the elongated casting channel to partially solidify the molten metal within the flow-restricting orifice and completely solidify the molten metal after leaving the flow-restricting orifice.

18. Apparatus for casting elongated, uniform metal products comprising an elongated casting channel in a chill body, means for cooling the casting channel, a source of molten metal, means for providing relative motion between the source of molten metal and the casting channel, and metering means for delivering the molten metal from the source thereof to the casting channel in which an elongated metal product is solidified, wherein the metering means includes a flow-restricting orifice comprised of a portion of the casting channel and a complementary volume-control channel of such size that the flow-restricting orifice has a minimum cross-sectional area which is not substantially larger than the cross-sectional area of the elongated metal product, and wherein the means for cooling the casting channel is such that the molten metal is partially solidified within and completely solidified after leaving the flow-restricting orifice.

19. The apparatus of claim 18 wherein the metering means further comprises a drain providing molten metal communication between the source of molten metal and the flow-restricting orifice.

20. The apparatus of claim 18 which further comprises a barrier fixed to the molten metal source and extending into the casting channel upstream of the flow-restricting orifice for preventing the molten metal from flowing in the casting channel upstream of the flow-restricting orifice.

21. The apparatus of claim 18 wherein the elongated casting channel has a semi-cylindrical shape.

22. The apparatus of claim 21 wherein the elongated casting channel is defined by a semi-cylindrical casting surface formed in a surface of a chill block.

23. The apparatus of claim 22 wherein the elongated casting channel is formed in an upper surface of the chill block.

24. The apparatus of claim 23 wherein the semi-cylindrical casting surface and the upper surface of the chill block meet to form a sharp edge.

25. The apparatus of claim 18 wherein the complementary volume-control channel has a semi-cylindrical shape forming a cylindrical flow-restricting orifice with the casting channel.

26. The apparatus of claim 18 wherein the source of molten metal comprises a tundish and wherein the complementary volume-control channel is formed in a lower surface of the tundish.

27. The apparatus of claim 18 wherein the elongated casting channel has a semi-cylindrical shape, the source of molten metal is a tundish having the complementary volume-control channel formed with a semi-cylindrical shape in a lower surface thereof and wherein the elongated casting channel and the volume-control channel cooperate to form the flow-restricting orifice with a cylindrical shape.

* * * * *